United States Patent [19]

Lenzmeier

[11] Patent Number: 4,485,926

[45] Date of Patent: Dec. 4, 1984

[54] TWIN CARTON PACKAGE WITH REMOVABLE PORTIONS

[75] Inventor: Thomas E. Lenzmeier, Chanhassen, Minn.

[73] Assignee: Container Corporation of America, Chicago, Ill.

[21] Appl. No.: 408,734

[22] Filed: Aug. 17, 1982

[51] Int. Cl.[3] ..... B65D 5/54

[52] U.S. Cl. ..... 206/602; 229/27

[58] Field of Search ..... 229/70, 27; 206/602, 206/627

[56] References Cited

U.S. PATENT DOCUMENTS

| | | | |
|---|---|---|---|
| 938,981 | 11/1909 | Cornell . | |
| 1,486,695 | 3/1924 | Singer et al. . | |
| 1,680,028 | 8/1928 | Ryan et al. | 229/27 |
| 1,988,280 | 1/1935 | Lerkoff | 229/27 |
| 2,387,790 | 10/1945 | Williamson | 229/27 |
| 3,028,070 | 4/1962 | Schnur . | |
| 3,048,321 | 8/1962 | Sanford | 206/602 |
| 3,135,457 | 6/1964 | Risucci | 206/602 |
| 3,183,614 | 5/1965 | Loderhose | 229/70 |
| 3,341,103 | 9/1967 | May | 229/27 |
| 3,358,824 | 12/1967 | Stagnitto | 206/459 |
| 3,510,046 | 5/1970 | Reiner | 206/602 |
| 3,918,631 | 11/1975 | Hackenberg | 229/37 |

FOREIGN PATENT DOCUMENTS

| | | | |
|---|---|---|---|
| 739899 | 11/1955 | United Kingdom | 206/602 |

*Primary Examiner*—Stephen P. Garbe

*Attorney, Agent, or Firm*—Richard W. Carpenter

[57] ABSTRACT

A package comprising a pair of twin cartons joined to each other by an integral connecting panel having removable portions.

2 Claims, 6 Drawing Figures

TWIN CARTON PACKAGE WITH REMOVABLE PORTIONS

BACKGROUND OF THE INVENTION

1. Field of the Invention

This invention relates to folding cartons formed of paperboard and more particularly to a package including a pair of interconnected twin cartons having detachable inventory control tags of the type which are necessary in the ophthalmic lens blank industry.

It is an advantage to provide a package having twin carton structures interconnected by an integral connecting panel with detachable inventory control tag portions and which is formed from a single blank of paperboard. Such an arrangement provides a more attractive package and one with complete color consistency between the two carton portions of the package and the connecting panel inventory control tags.

2. Description of the Prior Art

A prior art search directed to the subject matter of this application in the U.S. Patent and Trademark Office disclosed the following U.S. Pat. Nos.: 938,981; 1,486,695; 1,680,028; 1,98,280; 2,387,790; 3,028,070; 3,341,103; 3,358,824; 3,918,631; 4,128,954.

None of the prior art patents uncovered in the search disclosed a package having a pair of twin cartons positioned in side-by-side relation and interconnected by a common panel having a pair of separate detachable portions.

SUMMARY OF THE INVENTION

It is an object of the invention to provide a package including a pair of similar tubular carton structures which are interconnected by a common panel having detachable portions.

A more specific object of the invention is the provision, in a package of the type described, of a common connecting panel having a pair of panel sections, each with a removable portion, and wherein the panel sections have their remote edges foldably joined to adjacent edges of respect carton structures side walls and have their adjacent edges foldably joined to each other along a preferably perforated fold line.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 2:
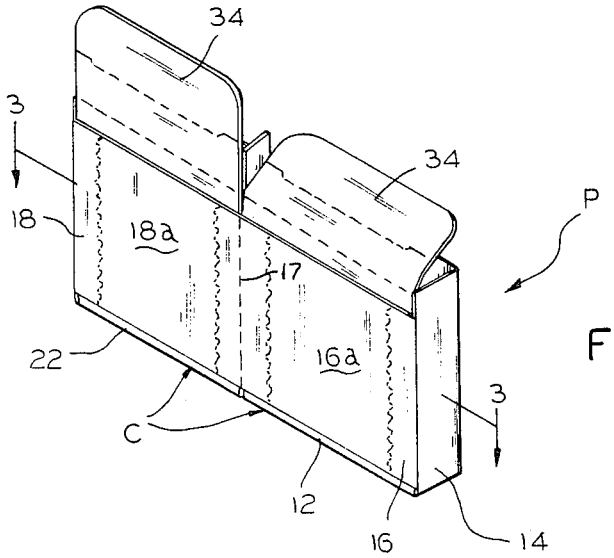
FIG. 2 is a view similar to FIG. 1, but illustrating the package before the ends of the individual carton structures have been closed.
Figure 3:
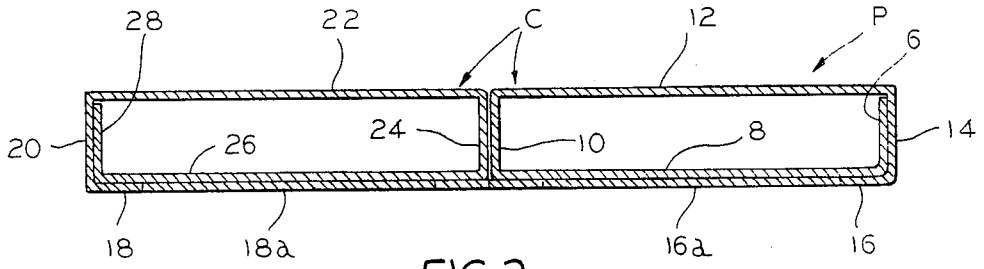
FIG. 3 is a fragmentary transverse sectional view taken on line 3—3 of FIG. 2.
Figure 1:
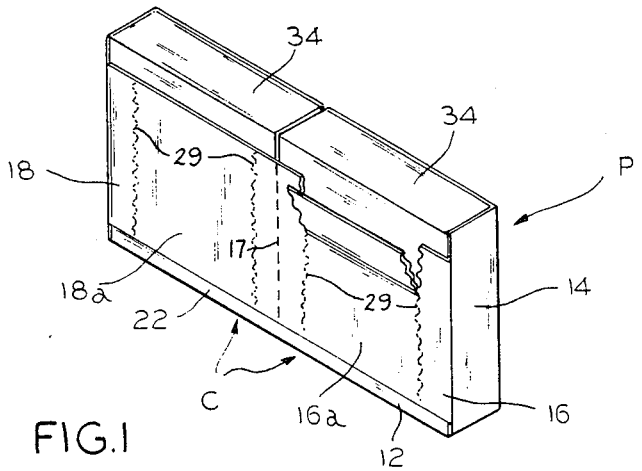
FIG. 1 is a perspective view of a package embodying features of the invention, as seen in the erected and closed condition.
Figure 4:
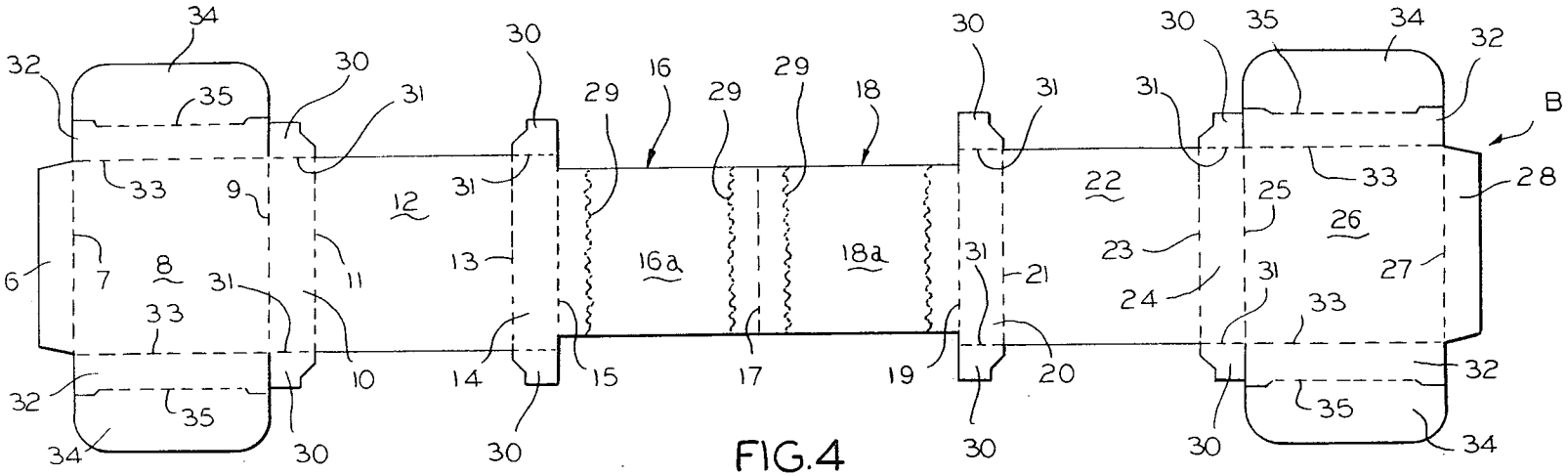
FIG. 4 is a plan view of a blank of foldable sheet material from which the package illustrated in the other views may be formed.
Figure 6:
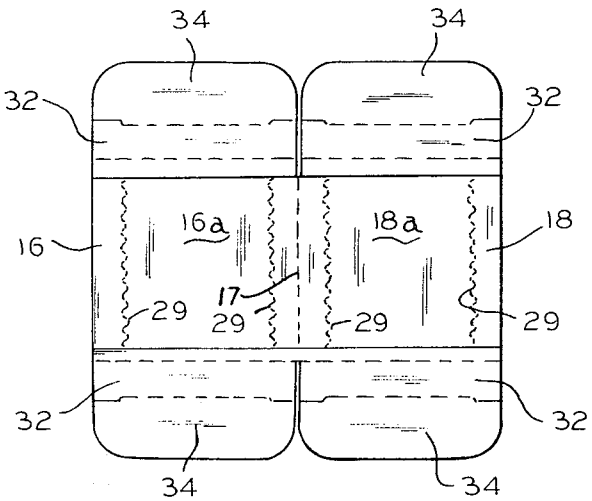
FIGS. 5 and 6 are front and rear elevational views, respectively, of the structure illustrated in FIG. 2.
Figure 5:
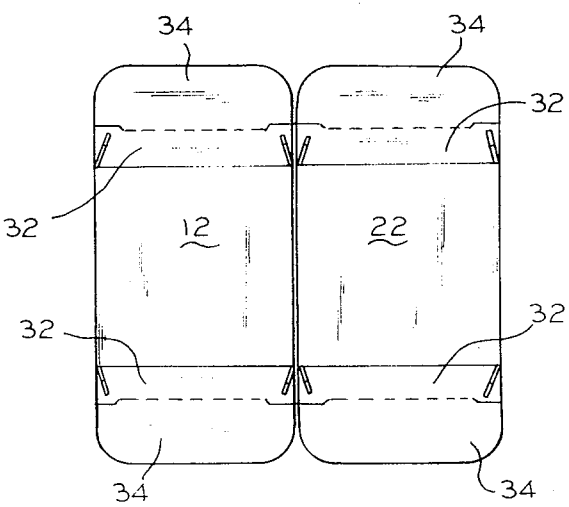

Referring now to the drawings for a better understanding of the invention, and particularly to FIGS. 1, 2, and 3, it will be seen that the novel package, indicated generally at P and embodying features of the invention, includes a pair of individual carton structures C which may be formed from the unitary blank B of foldable sheet material illustrated in FIG. 4.

Now turning to FIG. 4 specifically, it will be seen that the main portion or body of the carton blank B includes the following panels as viewed from left to right: first carton glue flap 6, first carton rear wall panel 8, first carton first side wall panel 10, first carton front wall panel 12, first carton second side wall panel 14, first carton identification panel 16, second carton identification panel 18, second carton second side wall panel 20, second carton front wall panel 22, second carton first side wall panel 24, second carton rear wall panel 26, and second carton glue flap 28.

The previously mentioned panels are foldably joined to each on parallel fold or severance lines 7, 9, 11, 13, 15, 17, 19, 21, 23, 25, and 27, respectively.

Still referring to FIG. 4, it will be seen that each of the side wall panels 10, 14, 20, and 24, has a pair of inner closure flaps 30 foldably joined to opposite ends thereof on fold lines 31. Each of the rear wall panels 8 and 26 has a pair of closure panels 32 foldably joined to opposite ends thereof on fold lines 33. The panels 32, in turn, each has a tuck flap 34 foldably joined to another edge thereof along a fold line 35.

When the package P is in erected condition, as shown in FIGS. 1, 2, and 3, it will be seen that the carton structures C are positioned in side-by-side relation, with corresponding side wall panels 10 and 24 disposed in face-to-face relation and with rear wall panels 8 and 26 disposed in edge-to-edge relation.

The two carton structures are interconnected by means of a pair of identification panels 16 and 18 which are foldably joined at their remote side edges on fold lines 15 and 19 to respective carton side wall panels 14 and 20 and which have their adjacent side edges separably joined to each other on a severance line 17, which is preferably a perforated line facilitating the separation of the cartons from each other.

The panels 16 and 18 are provided with a detachable or removable panel portions 16*a* and 18*a*, respectively, each of which is defined by a pair of preferably parallel weakened lines of tear 29.

Thus, it will be appreciated that the invention provides an integral package which can be formed from a unitary blank of foldable paperboard and which includes a pair of separate but articulated carton structures joined by a connecting panel having detachable portions which serve as inventory control tags.

What is claimed is:

1. A package including a pair of articulated cartons joined to each other by an integral connecting panel having separate detachable portions, said package being formed from a unitary blank of foldable sheet material, such as paperboard, and comprising:

(a) a pair of similar cartons disposed in side-by-side relation and each carton including a pair of front and rear wall panels and a pair of side wall panels having front and rear side edges foldably joined to and extending between respective front and rear wall panels to form therewith a tubular structure open at the ends;

(b) an integral panel extending across the rear wall panels of said cartons, in face-to-face relation therewith, and including:

(i) a pair of sections having remote side edges foldably joined to corresponding rear edges of respective carton side wall panels and having adjacent side edges separably joined to each other along a perforated severance line to facilitate separation of said pair of cartons from each other;

(ii) each of said connecting panel sections including one of said detachable portions defined by a pair of transversely spaced weakened lines of tear, said weakened lines being disposed inwardly of said corresponding rear edges of the respective side wall panels;

(iii) each of said connecting panel sections being of a width and height which is smalller than said rear wall panels;

(c) means for closing the ends of said carton structures.

2. A blank of foldable sheet material, such as paperboard, for use in forming a package which includes a pair of carton structures joined to each other by an integral connecting panel, said blank being cut and scored to provide in series connection:

a first carton glue flap;
a first carton rear wall panel;
a first carton first side wall panel;
a first carton front wall panel;
a first carton second side wall panel;
an integral connecting panel;
a second carton second side wall panel;
a second carton front wall panel;
a second carton first side wall panel;
a second carton rear wall panel;
a second carton glue flap;

all of the aforementioned flaps and panels being joined to each other along parallel and spaced fold lines;

closure flaps joined to end edges of said first and second carton rear wall and side wall panels;

said integral connecting panel including a pair of panel sections joined to each other on a perforated severance line;

each of said panel sections including a detachable portion defined by a pair of parallel weakened lines of tear; and each detachable portion being of a width and a height which is less than the width and height of each of said rear wall panels.

* * * * *